United States Patent [19]

Fukayama et al.

[11] Patent Number: 4,928,604

[45] Date of Patent: May 29, 1990

[54] CONTROL SYSTEM FOR PULVERIZED COAL FIRED BOILER

[75] Inventors: Yukio Fukayama; Taku Oshima, both of Kure, Japan

[73] Assignee: Babcock-Hitachi Kabushiki Kaisha, Tokyo, Japan

[21] Appl. No.: 358,412

[22] Filed: May 30, 1989

[30] Foreign Application Priority Data

May 31, 1988 [JP] Japan ..... 63-131342

[51] Int. Cl.[5] ..... F23K 3/00; F22B 37/42

[52] U.S. Cl. ..... 110/103; 122/449; 236/15 BA

[58] Field of Search ..... 236/46 B, 15 BA; 122/449; 110/186, 103

[56] References Cited

U.S. PATENT DOCUMENTS 4,430,963 2/1984 Finet ..... 122/449

4,628,830 12/1986 Kozlak ..... 110/186

4,846,081 7/1989 Homer et al. ..... 110/186

*Primary Examiner*—William E. Wayner

*Attorney, Agent, or Firm*—Antonelli, Terry, Stout & Kraus

[57] ABSTRACT

A control system for a pulverized coal fired boiler provided with a pulverized coal producing equipment including a coal feeding section, a milling section and a classifying section and an adjuster for adjusting a coaling rate thereof, and a pulverized coal burning equipment for burning the pulverized coal supplied from the pulverized coal producing equipment includes an estimation apparatus for estimating a coaling rate of coal out form the pulverized coal producing equipment, and an apparatus for operating the adjuster to adjust a coaling rate of coal supplied from the pulverized coal producing equipment to the pulverized coal burning equipment on the basis of an estimation of the estimation apparatus. The estimation is conducted by calculation of mathematical models which are obtained with taking the physical mechanism in the pulverized coal producing equipment and simulate a heat input with higher accuracy.

1 Claim, 6 Drawing Sheets

CONTROL SYSTEM FOR PULVERIZED COAL FIRED BOILER

THE INVENTION AND RELATED ART STATEMENT

The present invention relates to a control system for a pulverized coal fired boiler and, more particularly, to control system which permits the boiler to work under a large load fluctuation.

Nowadays, it is generalized to adjust the demand and supply of electric power in the thermal power plant (or to operate the plant at intermediate-load), and to use various fuels. It is therefore an important subject from the viewpoint of thermal power plant control techniques to improve the intermediate-load operating performance such as reduction of start-up time required for large-capacity coal fired boilers.

In order to realize the start-up performance in the coal fired boiler which performance is equal to or higher than that of a conventional oil fired intermediate-load boiler, it is necessary to overcome prolongation of the start-up time due to application of the pulverized coal mills which inevitably occupies a considerable part of the process of start-up of a conventional coal fired boiler.

As far as concerned with the present technical level, a minimum amount of supply of pulverized coal (turndown) from a pulverized coal mill is about 40% of a maximum rated supply thereof In an ordinary coal fired boiler, pulverized coal required for combustion is supplied from a plurality of mills. The number of mills in operation must be varied to maintain a load of each mill to be between 40% and 90% of the rated value thereof. In a start-up process or a process during which the load is increased beyond a certain extent, it becomes necessary to inevitably operate a large number of mills.

More specifically, in the start-up process of the latest supercritical large-capacity coal fired thermal power plant, for example, an oil burner works from ignition till minimum steady load of the plant (which is about 15% of the rated load of the plant) and, thereafter, five mills are operated sequentially at intervals of about 10 to 20 minutes while keeping the load at constant level or increasing a low load fluctuation of 1%/min or so. Therefore, it requires about 120 minutes to raise the minimum steady load operation up to the full load operation. This results in a remarkable prolongation of the start-up time in comparison with the fact that the full load can be attained in 40 minutes in an oil/gas fired thermal power plant of the same capacity.

The above-described prolongation of the start-up owing to the application of pulverized coal mills is essentially due to the fact that the boiler heat input control system which controls the pulverized coal mills can not respond to a high load fluctuation.

The above-described problem of prolongation of the start-up is attributable to a low accuracy of presumption in an amount of pulverized coal supplied from a mill.

OBJECT AND SUMMARY OF THE INVENTION

Accordingly, an object of the present invention is to provide a control system for a pulverized coal fired boiler, which can presume an amount of pulverized coal supplied from the mill with a higher accuracy and operate the pulverized coal fired boiler under a large load fluctuation, thereby saving the start-up time period of the boiler.

To this end, according to the present invention, a presumption in an amount of pulverized coal supplied from a mill is made with taking a milling mechanism in the mill and a grain size distribution of the pulverized coal therein into consideration. The milling mechanism includes a milling, a classifying and so on.

The above and other advantages of the present invention will become more apparent from the following description of the preferred embodiment taken in connection with the accompanying drawings.

DETAILED DESCRIPTION OF PREFERRED EMBODIMENTS

Figure 1:
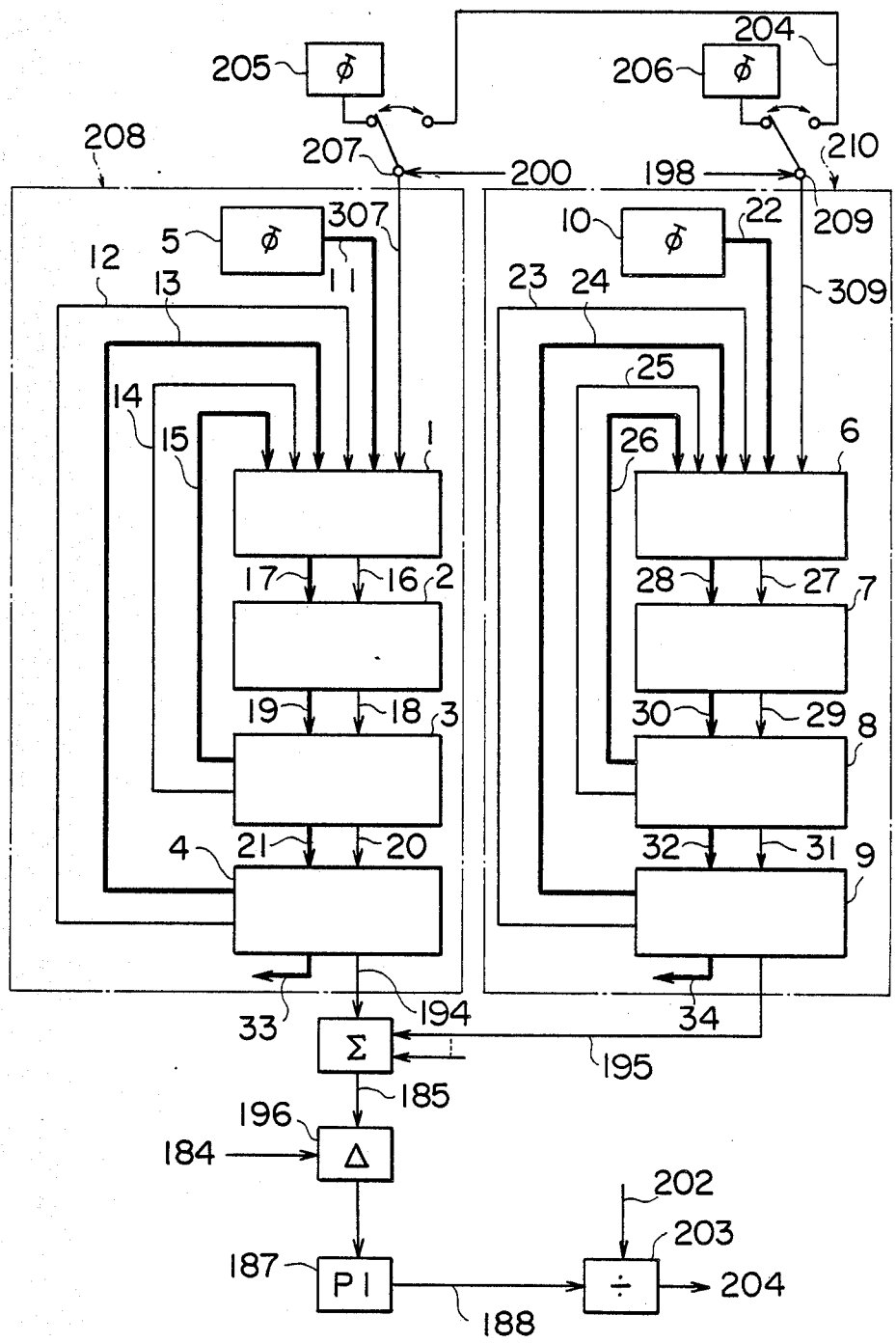
FIG. 1 is a block diagram showing a process for estimating a coaling rate of a pulverized coal mills, in a control system according to a first embodiment of the present invention.
Figure 4:
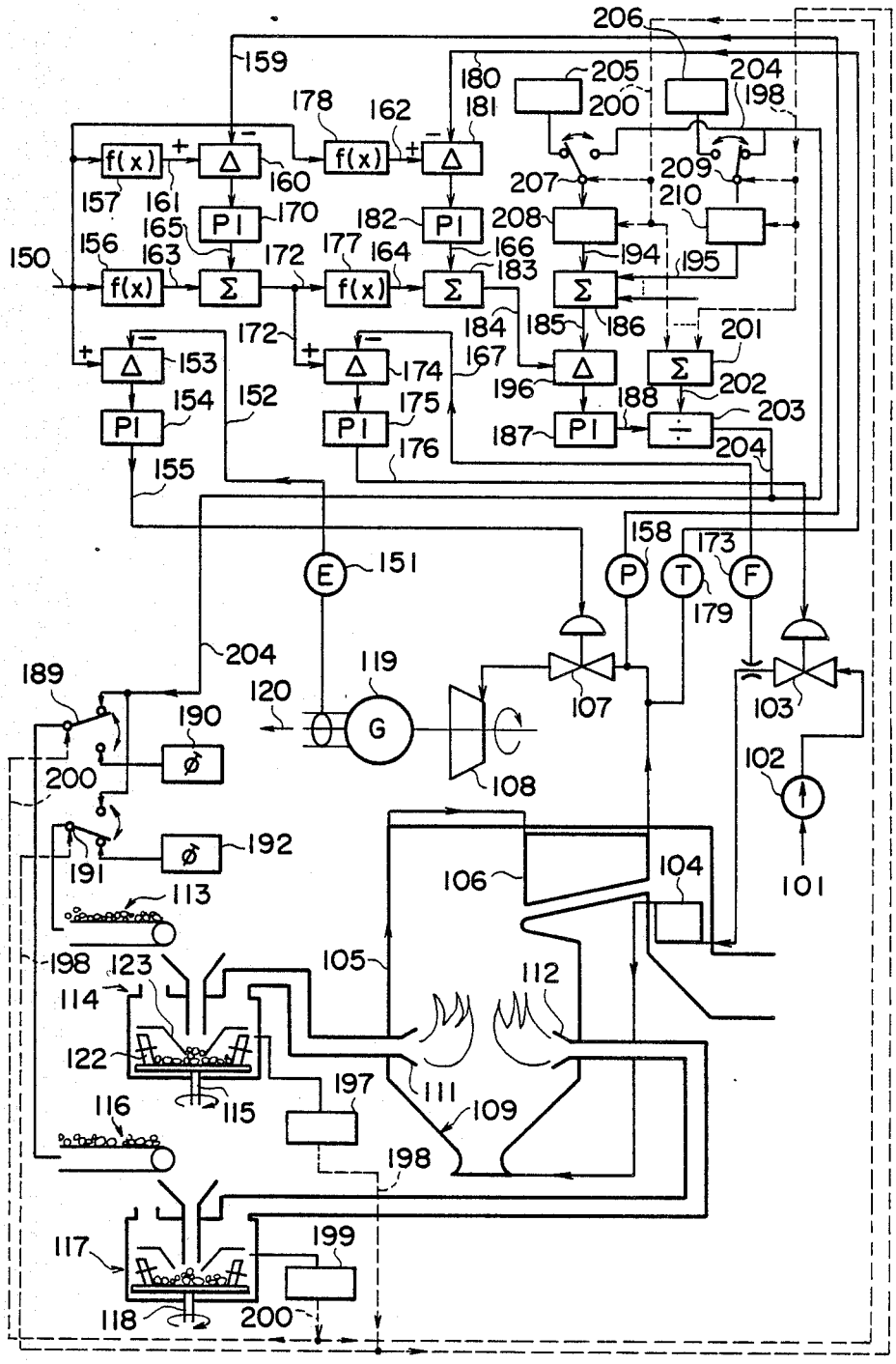
FIG. 4 is a block diagram a boiler incorporating a control system.

FIG. 1 shows a block diagram of a process for estimating a coaling rate of a pulverized coal mill, in a control system which is applied to a controlled system including a boiler and pulverized coal mills shown in FIG. 4.

Referring to FIG. 4, an operation of the controlled system will be described hereinunder.

A feed water pump 102 pumps up feed water 101 through a feed water flow control valve 103 into an economizer 104 to preheat the feed water. The preheated feed water is completely evaporated into steam while it rises up along a water wall 105 surrounding a furnace 109. Steam thus produced flows through a superheater 106 and a governor 107 into a steam turbine 108 so as to drive a generator 119 to produce electric power 120.

The control system aims to make the electric power 120 follows a load command 150 while keeping a steam temperature and a steam pressure at an inlet of the turbine 108 at the predetermined values. This control system operates in the following manner.

According to the load command 150, function generators 157, 178 and 156 generate a steam pressure command 161, a steam temperature command 162 and a feed water flow rate command 163, respectively. The governor 107 is so driven in accordance with a governor opening degree command signal 155 that a generated energy signal 152 from a generated energy detector 151 agrees with the load command signal 150. The governor opening degree command signal 155 is obtained from a proportional-integral controller (PI controller) 154 as a result of calculation of a deviation signal which is obtained by a subtracter 153 through calculation between the load command signal 150 and the generated energy signal 152.

Unbalance between the boiler feed water 101 and the steam to be fed to the turbine 108 immediately brings about a fluctuation of the steam pressure. Accordingly, a subtracter 160 calculates a deviation signal between a steam pressure signal 159 from a steam pressure detector 158 and the steam pressure command 161, and a PI controller 170 receives such deviation signal and generates a steam pressure correction signal 165. The steam pressure correction signal 165 is added with the feed water rate command 163 into a feed water flow command signal 172. The feed water flow control valve 103 is so driven in accordance with a signal 176 that a feed water flow signal 167 from a feed water flow detector 173 agrees with the feed water flow command signal 172. The signal 176 is obtained from a PI controller 175 as a result of calculation of a deviation signal which is obtained by a subtracter 174 through calculation between the feed water flow command signal 172 and the feed water flow signal 167.

On the other hand, since fluctuation of the temperature of steam generated in the boiler causes thermal stress particularly in blades of the steam turbine 108 and may bring about a very critical condition, it must be suppressed as small as possible. To cope with this, it is necessary to deal with the boiler heat input control which is ascribable to an operation of fuel supply system. In this embodiment, a boiler heat input command 164 obtained from the feed water flow command signal 172 through a function generator 177 is added in an adder 183 with a steam temperature correction signal 166 to obtain a boiler heat input command 184. The signal 166 is obtained through a PI controller 182 from a deviation signal between a steam temperature signal 180 from a steam temperature detector 179 and the above-described command 162 obtained by means of a subtracter 181.

As described above, the pulverized coal mill is unstable under a low load condition less than 40% of full load thereof. During a time period from the moment when the coal feeder is started to the moment when the load of a mill reaches upto 40% of full load thereof, the mill is referred as "under starting", and after the moment when the load has reached that value, the mill is referred as "under completion". It is possible to judge whether the mill is in a stable state or not by means of observation of conditions such as temperature at an outlet of the mill and the differential pressure in the mill.

The subtracter 196 calculates a deviation signal between the heat input command 184 and an estimation signal 185, and a PI controller 187 calculates a coal feeder drive supreme command 188 according to such deviation signal. In order to obtain an amount of pulverized coal required to be supplied to the boiler by means of using the mills under completion, a coal feeder drive command 204 is obtained by dividing the supreme command 188 by a signal 202 representing the total number of the mills under completion in a divider 203, and is supplied to the respective coal feeders 113, 116 and so on to drive them. The estimation signal 185 is obtained by summing up in an adder 186 the respective signals 194, 195 and so on from estimation circuits 208, 210 and so on described later in details.

State observes 197 and 199 associated with pulverized coal mills 114 and 117, respectively, output mill start-up completion signals 198 and 200. FIG. 4 shows only the pulverized coal mill 117 which is under completion and the pulverized coal mill 114 which is under starting, and other mills are omitted. However, every mill has the mill state observer. The mill start-up completion signals from these observes are summed up in an adder 201 to obtain a signal 202 representing the total number of the mills in operation.

The pulverized coal mill 117 under completion is in a stable state and then can contribute to the heat input control of the plant. Therefore a signal switcher 189 associated with the mill 117 is switched over in response to the signal 200 so as to select the coal feeder drive command 204 in place of a signal from a coal feeder starting signal generator 190. The selected command 204 actuates the coal feeder 116 associated with the mill 117 to change the rate of supply of coal to the mill 117. This is equally true in the other mill under completion which are not shown.

On the other hand, the mill 114 under starting must be operated in accordance with sequential procedures such as to complete a starting smoothly. The coal feeder 113 associated with the mill 114 under starting must be driven according to a coal feeder driving signal from a coal feeder starting signal generator 192. The coal feeder driving signal is predetermined and suitable for starting up the mill, and is selected in place of the command 204 by a signal switcher 191 switched over in response to the signal 198.

Figure 7:
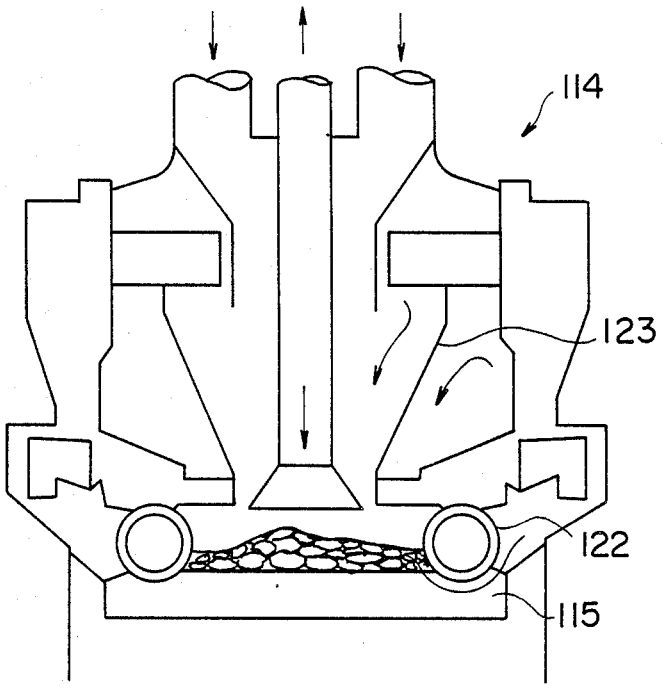
FIG. 7 is a schematic view of the pulverized coal moll.

The coaling estimation circuit is constituted by three calculating portions corresponding to the respective portions in the pulverized coal mill. These calculating portions will be explained hereinunder in connection with the mill 114 shown in FIG. 4, for example. Details of the arrangement of this mill is illustrated in FIG. 7.

Coal supplied from the coal feeder 113 drops onto a turntable 115 and coarse coal thereof is mixed with primary classified coal in a primary classifying portion, which is dropped by gravity thereof and is on the turntable 115 before reaching classifying vanes 123. The coarse coal is swirled by inlet vanes on passing into the classifying portion 123, and is further mixed by the centrifugal force with secondary classified coal in a secondary classifying portion, which is dropped onto the turntable 115, thereby accumulating on the turntable 115. A part of accumulated coal is caught in a milling portion. The first calculating portion simulates the above-described mechanism.

Rollers (balls) 122 are provided on the turntable 115 so as to mill the coal caught therein and blow upward the milled coal into the primary classifying portion by the centrifugal force. The second calculating portion simulates the above-described mechanism.

Although, the primary classifying portion and the secondary classifying portion are different from each other in the physical mechanism, they can be treated in the same mathematical manner (by making use of different classifying characteristic functions) from the viewpoint of their classifying function. A third calculating portion, therefore, is provided for simulating the above-described mathematical manner. It is possible not only to assign the individual third calculating portions to each classifying portion (as shown in this embodiment) but also to treat the compound characteristic of the both classifying portions by a single third calculating portion.

These calculating portions will be mathematically explained hereinunder in details.

(1) First calculating portion

Assuming that a flow rate of coal supplied from the coal feeder is Qi, a grain size distribution function is Fi(ξ) (which indicates the rate of particles with a grain size of not larger than $\xi$), and the flow rates and the grain size distribution functions of the coal dropped due to the primary and secondary classifying operations are $Q_{r1}$, $Q_{r2}$, $F_{r1}(\xi)$ and $F_{r2}(\xi)$, respectively, a mass balance expressed as the following equation is obtained on the turntable in regard to the particles with the grain size of not larger than $\xi$.

$$\frac{dW_oF_o(\xi)}{dt} = Q_iF_i(\xi) + Q_{r1}F_{r1}(\xi) + Q_{r2}F_{r2}(\xi) - Q_oF_o(\xi) \quad (101)$$

where $Q_o$ represents the flow rate of the coal to be caught in the milling portion, and $F_o(\xi)$ represents the grain size distribution function of the same coal.

The equation (101) is rewritten as followings.

$$W_o\frac{dF_o(\xi)}{dt} = Q_iF_i(\xi) + Q_{r1}F_{r1}(\xi) + Q_{r2}F_{r2}(\xi) - Q_oF_o(\xi) - F_o(\xi)\frac{dW_o}{dt} \quad (102)$$

The following equation must be established from the properties of the distribution function.

$$F_o(\infty)=F_i(\infty)=F_{r1}(\infty)=F_{r2}(\infty)=1 \quad (103)$$

In consequence, in the case of $\xi=\infty$, i.e. throughout the whole grain size, the equation (101) is turned into the following equation.

$$\frac{dW_o}{dt} = Q_i + Q_{r1} + Q_{r2} - Q_o \quad (104)$$

The equation is derived from by substituting the equation (104) for the equation (102).

$$W_o\frac{dF_o(\xi)}{dt} = Q_i\{F_i(\xi) - F_o(\xi)\} + Q_{r1}\{F_{r1}(\xi) - F_o(\xi)\} + Q_{r2}\{F_{r2}(\xi) - F_o(\xi)\} \quad (105)$$

$f(\xi)$ obtained as a result of differentiation of the distribution function $F(\xi)$ is generally referred to as a distribution density function and expresses the abundance probability density of the particles with a grain size of $\xi$ or so. The following equation is obtained by differentiating the equation (105) with respect to $\xi$.

$$W_o\frac{dF_o(\xi)}{dt} = Q_i\{f_i(\xi) - f_o(\xi)\} + Q_{r1}\{f_{r1}(\xi) - f_o(\xi)\} + Q_{r2}\{f_{r2}(\xi) - f_o(\xi)\} \quad (106)$$

where $f_i(\xi)$, $f_o(\xi)$, $f_{r1}(\xi)$ and $f_{r2}(\xi)$ represent the distribution density functions of the grain size distribution functions $F_i(\xi)$, $F_o(\xi)$, $F_{r1}(\xi)$ and $F_{r2}(\xi)$, respectively.

It is assumed that the flow rate $Q_o$ at which the coal is caught in the milling portion is in proportion to the mass $W_o$ of the coal on the turntable.

$$Q_o=\epsilon_oW_o \quad (107)$$

In this way, by making use of the equations (104), (106) and (107), outputs of the first calculating portion, that is, $Q_o$ and $f_o(\xi)$, can be obtained.

(2) Second calculating portion

A milled particle distribution function $M(\xi, \#)$ gives the rate of the particles with a grain size of not larger than $\xi$ produced by milling the particles with a grain size of $\xi$ or so. The abundance probability of the particles of coal with a grain size of $\tau$ or so before milling is expressed as the following equation.

$$dF_o(\tau)=f_o(\tau)\,d\tau \quad (150)$$

Accordingly, a distribution density function $G_o(\tau)$ of the coal after milling is expressed as the following equation.

$$G_o(\xi) = \int_0^\infty M(\xi, \tau)\,dF_o(\tau) \quad (151)$$

Assuming that the distribution density for the distribution density function $G_o(\xi)$ is $g_o(\xi)$, the following equation is obtained.

$$g_o(\xi) = \int_0^\infty m(\xi, \tau)f_o(\tau)dt \quad (152)$$

where $m(\xi, \tau)$ represents the milled particle distribution density function obtained by partially differentiating the milled particle distribution function $M(\xi, \tau)$ with respect to $\xi$.

In the secondary classifying portion, on the assumption that the coal flow $Q_o$ introduced hereinto is allowed to flow out as it is, $g_o(\xi)$ is calculated in accordance with the equation (152) to obtain a desired output.

(3) Third calculating portion

Assuming that the passing flow rate is $Q_l$, the flow rate at which the coal is collected and dropped onto the turntable is $Q_r$, and the quantity of pulverized coal retained in the classifying portion is $W_l$, the characteristic of the classifying portion is expressed as the following equations.

$$\frac{dW_1}{dt} = Q_o - Q_t \quad (200)$$

On the assumption that $Q_t$ is in proportion to $W_l$, the following equation is obtained.

$$Q_t=\epsilon_lW_l \quad (202)$$

A classifying efficiency $C(\xi)$ is defined as the probability at which the particles with a grain size of $\xi$ or so are collected. Assuming that the grain size distribution density of the coal which is allowed to pass through the classifying portion and that of the coal which is collected therein are $g_l(\xi)$ and $g_r(\xi)$, respectively, the following equations are established.

$$r = \int_0^\infty C_1(\xi)g_o(\xi)d\xi \quad (203)$$

$$Q_l=(131\ r)\ Q_t \quad (204)$$

$$Q_r=rQ_t \quad (205)$$

$$g_1(\xi) = \frac{1}{1-r}\{1 - C_1(\xi)\}g_o(\xi) \quad (206)$$

$$g_r(\xi) = \frac{1}{r}C_1(\xi)g_o(\xi) \quad (207)$$

By making use of the equations (200) to (206), the outputs of the third calculating portion, that is, $Q_l$, $g_l(\xi)$, $Q_r$ and $g_r(\xi)$, can be calculated.

The above-described estimation procedure will be explained hereinunder in details with referring to FIG. 1. In the drawings, the estimation circuits 208 and 210 associated with the mills 117 and 114 are shown by way of illustration. Other estimation circuits associated with the mills other than the mills 117 and 114 have the same arrangement as that of the circuits 208 and 210, and therefore are omitted from the drawings for simplifying the explanation. Because of the same reasons, the explanation will be made on the circuit 208 only.

Referring to FIG. 1, a first calculating portion 1 simulates the mechanism of the turntable 115 in the mill 114. The portion 1 receives a signal 307 indicative of the rate of supply of the coal, a signal 11 indicative of the grain size distribution set by a feed coal grain size distribution setter 5, a signal 14 indicative of the flow rate of the coal collected through the primary classifying, a signal 15 indicative of the grain size distribution density of the coal in the primary classifying, a signal 12 indicative of the flow rate of the coal collected through the secondary classifying and a signal 13 indicative of the grain size distribution density of the coal in the secondary classifying. The portion 1 generates signal 16 indicative of the quantity of the coal to be caught in the milling portion and a signal 17 indicative of the grain size distribution density of the same on the basis of the received signals.

Incidentally, a thin solid line represents a scalar, and a thick solid line represents a state vector.

A second calculating portion 2 simulates the milling characteristic of rollers 122 in the mill 114. The portion 2 receives the signals 16 and 17 from the portion 1 and generates a signal 18 indicative of the flow rate of the coal at an outlet of the milling portion and a signal 19 indicative of the grain size distribution density of the same on the basis of the received signals.

A portion 3 of third calculating means simulates the primary classifying. The portion 3 receives the signals 18 and 19 from the portion 2 and sends out the above-described signals 14 and 15 towards the portion 1 as well as a signal 20 indicative of the flow rate of the coal at the outlet of the primary classifying and a signal 21 indicative of the grain size distribution of the same.

Another portion 4 of the third calculating means simulates the secondary classifying. The portion 4 receives the signals 20 and 21 from the portion 3 and sends out the above-described signals 12 and 13 towards the portion 1 as well as a signal 195 indicative of the estimated value of the coaling rate of the mill 117 and a signal 33 indicative of the grain size distribution density of the coal supplied from the mill 117.

The first calculating portion 1 performs the calculation on the basis of the equations (104), (106) and (107). In this case, a continuous function $F(\xi)$ is treated as a vector f through the sampling. This is equally true in the other calculating portions.

$$f = \begin{pmatrix} u_1 \\ u_k \\ \vdots \\ u_n \end{pmatrix} \tag{301}$$

$$u_k = F(\xi_k),\ \xi_k = \xi_o + (k-1)\Delta\xi \tag{302}$$

where $\xi_o$ represents the starting point of sampling and $\Delta\xi$ represents the sampling interval.

The second calculating portion 2 performs the calculation on the basis of the equation (152). In this case, a bivariate function $m(\xi, \tau)$ is treated as a matrix M through the sampling.

$$M = \begin{pmatrix} v_{11} & v_{21} & v_{31} & \cdots & v_{n1} \\ v_{12} & v_{22} & & & \vdots \\ v_{13} & & v_{33} & & \vdots \\ \vdots & & & \ddots & \vdots \\ v_{im} & \cdot & & \cdot & v_{nm} \end{pmatrix} \tag{303}$$

$$v_{lk} = m(\xi_l, \tau_k)$$

$$\xi_l = \xi_o + (\xi - 1)\Delta\xi$$

$$\tau_k = \tau_o + (k-1)\Delta\xi \tag{304}$$

Accordingly, the equation (152) is actually calculated in the form of the following equation.

$$\mathcal{O}_o = Mf \tag{305}$$

The third calculating portions perform the calculating on the basis of the equations (200) to (206). The continuous function in the equations is treated as a vector or a matrix as is the case of the first and second calculating portions.

On the other hand, in the case of the coal fired boiler, however, as far as concerned with the present technical level, there exists no means for detecting momentarily an actual heat input (or actual rate of supply of coal), i.e. on-line detecting, which is an indispensable factor for a cascade control. Therefore, in a conventional control system, the heat input is approximately estimated by making use of first-order lag elements To the contrary, in the above-described embodiment, the estimation circuits 208 and 210 performing a vector or a matrix operation of mathematic models representative of the actual phenomena in the mill are used in place of the first-order lag elements.

The first-order lag element can not sufficiently describe the actual phenomena in the mill and then the conventional control system can not estimate the heat input (coaling rate of the mill) accurately.

The first-order lag element used for the estimation of the coaling rate in the conventional control system, as well known satisfies the following differential equation.

$$T = \frac{dy}{dt} = x - y$$

where x represents an input, y represents an output, and T represents a time constant.

Figure 5:
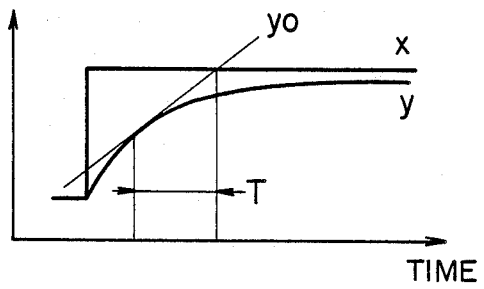
FIGS. 5 and 6 show step response and ramp response of a first-order lag, respectively.
Figure 6:
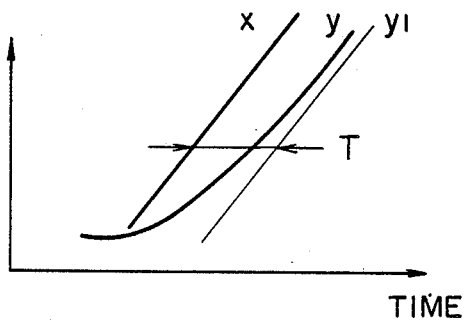

The step response and a lamp response of the first-order lag element are well known and shown in FIGS. 5 and 6, respectively. In these drawings, the time constant T can be read, and $y_O$ and $y_I$ represents an arbitrary tangent and an asymptote to the respective curves y.

As shown in FIGS. 5 and 6, the first order lag is a highly idealized characteristic. Therefore, it is unreasonable that the actual response of the pulverized coal mill can be approximated or estimated by a first-order lag element in which the time constant is fixed through the operating load and the state quantities change. Therefore, it has been considered to take a measure to change the time constant in accordance with the state of the mill, in view of the fact that the response lag in the start-up of the mill is greatly different from that after the completion of the start-up. However, even this measure is insufficient to simulate with a high accuracy the actual response of the mill, the characteristic of which varies continuously during the change of the operating condition.

As has been described in detail, it is considered that the limit of the conventional control system is attributable to the fact that physical mechanism in the mill such as milling and classifying are not taken into account in estimation of the coaling rate of the mill. Therefore, the present invention employs estimation measure which is obtained with taking the physical mechanism in the mill into consideration. The estimation measure according to the present invention can estimate the heat input on the coaling rate of the mill with a higher accuracy, thereby operating the coal fired boiler with suppressing the fluctuation of steam temperature as well as with a higher load change rate substantially equal to that of the oil fired boiler.

Figure 2:
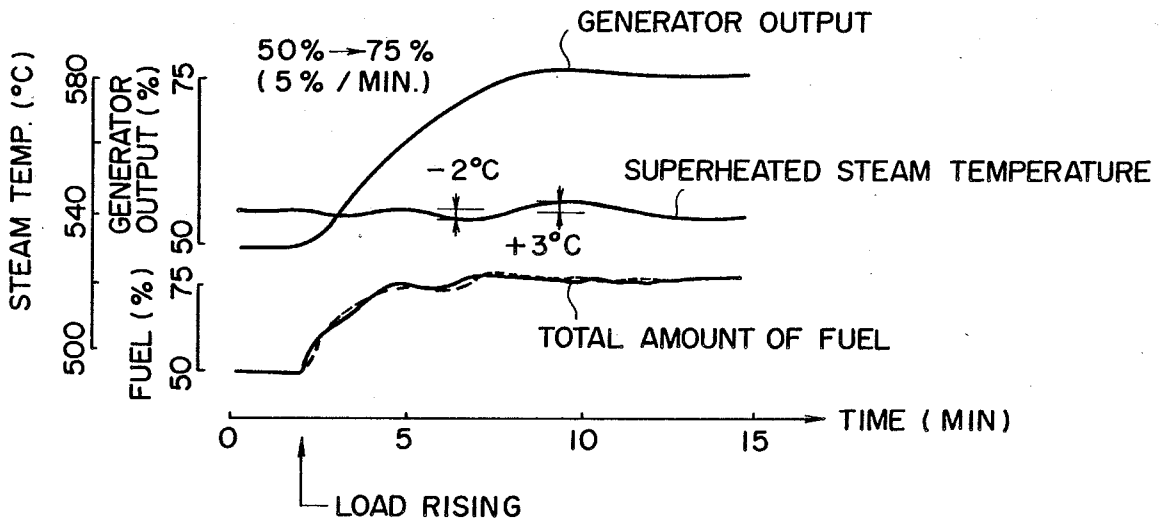
FIG. 2 is a graph showing the results of simulation of the load fluctuation characteristic of the boiler caused by the control system according to the invention.
Figure 3:
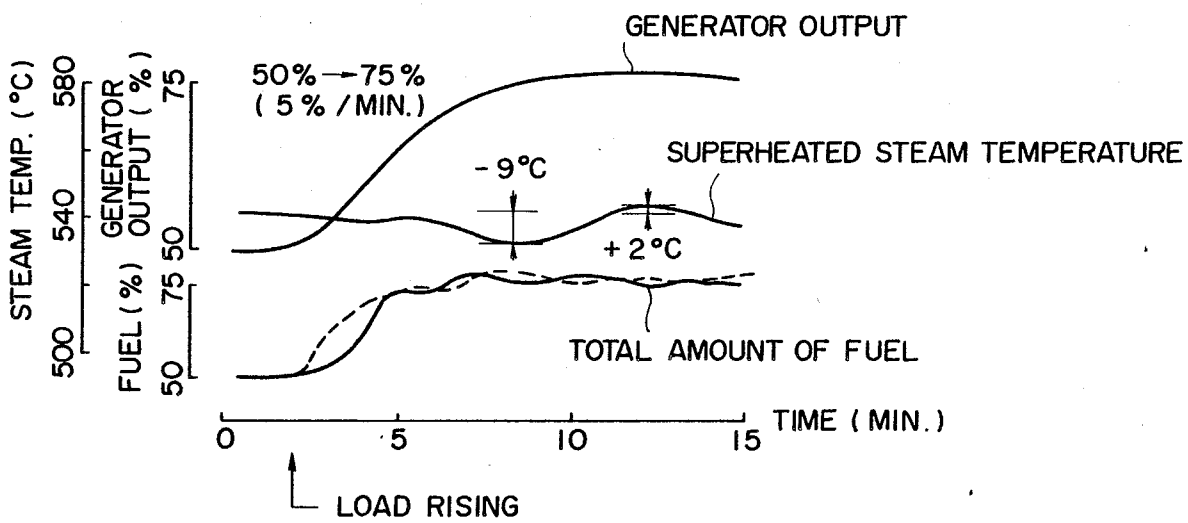
FIG. 3 is a graph showing the results of simulation of the load fluctuation characteristic of the boiler caused by a conventional control system.

FIGS. 2 and 3 show the results of analysis obtained by making use of a thermal power plant simulator "ACTUALISE" (see "Development and Application of Boiler Plant Simulator" by Fukayama et al., THERMAL POWER PLANT AND NUCLEAR POWER PLANT, Vol. 37, No. 11, pp. 1189 to 1199). As clearly understood in comparison with the results of analysis shown in FIG. 3 according to the conventional control system, according to the present invention, as shown in FIG. 2, the demand flow rate of fuel indicated by broken line exactly agrees with the total amount of fuel which is not measurable directly in the actual plant. In consequence, it is also understood that the fluctuation of steam temperature during increase in the load at 5%/min can be reduced from 9° C. to 3° C.

What is claimed is:

1. A control system for a pulverized coal first boiler provided with a pulverized coal producing equipment including a coal feeding section, a milling section and a classifying section and an adjuster for adjusting a coaling rate thereof, and a pulverized coal burning equipment for burning the pulverized coal supplied from said pulverized coal producing equipment, said control system comprising:

first calculating means reading in a flow rate and a grain size distribution of coal supplied from said coal feeding section, and a flow rate and a grain size distribution of coal supplied from said classifying section and calculating and outputting a flow rate and a grain size distribution of coal at an inlet of said milling section on the basis of said read flow rates and said read distributions;

second calculating means reading in said flow rate and said grain size distribution of the coal at said inlet of said milling section from said first calculating means and calculating and outputting a low rate and a grain size distribution of coal at an outlet of said milling section;

third calculating means reading in said flow rate and said grain size distribution of the coal at said outlet of said milling section from said second calculating means and calculating and outputting a flow rate and a grain size distribution of coal to be returned from an outlet of said classifying section to said milling section and a coaling rate at which coal is to be supplied to said pulverized coal burning equipment; and means for operating said adjuster to adjust a coaling rate at which coal is supplied from said pulverized coal producing equipment to said pulverized coal burning equipment on the basis of said coaling rate from said third calculating means.

* * * * *